US009581944B2

(12) United States Patent
Nakamura

(10) Patent No.: US 9,581,944 B2
(45) Date of Patent: Feb. 28, 2017

(54) FIXING DEVICE AND IMAGE FORMING APPARATUS

(75) Inventor: Satoru Nakamura, Osaka (JP)

(73) Assignee: KYOCERA DOCUMENT SOLUTIONS, INC., Osaka (JP)

( * ) Notice: Subject to any disclaimer, the term of this patent is extended or adjusted under 35 U.S.C. 154(b) by 0 days.

(21) Appl. No.: 13/813,412

(22) PCT Filed: Sep. 4, 2012

(86) PCT No.: PCT/JP2012/072397
§ 371 (c)(1),
(2), (4) Date: Jan. 30, 2013

(87) PCT Pub. No.: WO2013/058022
PCT Pub. Date: Apr. 25, 2013

(65) Prior Publication Data

US 2015/0132034 A1 May 14, 2015

(30) Foreign Application Priority Data

Oct. 17, 2011 (JP) ..... 2011-227888

(51) Int. Cl.
*G03G 15/20* (2006.01)

(52) U.S. Cl.
CPC ..... *G03G 15/2028* (2013.01); *G03G 15/2085* (2013.01)

(58) Field of Classification Search
CPC ..... G03G 15/2028
USPC ..... 399/323
See application file for complete search history.

(56) References Cited

U.S. PATENT DOCUMENTS

| | | | | |
|---|---|---|---|---|
| 4,168,902 | A * | 9/1979 | Golz | 399/399 |
| 5,046,947 | A | 9/1991 | Endoh et al. | |
| 5,072,255 | A * | 12/1991 | Kono | 355/58 |
| 2002/0141792 | A1* | 10/2002 | Nakano | G03G 15/2028 399/323 |
| 2006/0269332 | A1* | 11/2006 | Yamanaka et al. | 399/323 |
| 2007/0053728 | A1* | 3/2007 | Shiokawa et al. | 399/323 |
| 2012/0008991 | A1* | 1/2012 | Shimizu | 399/297 |
| 2012/0063822 | A1* | 3/2012 | Funabiki et al. | 399/323 |

FOREIGN PATENT DOCUMENTS

| | | | |
|---|---|---|---|
| JP | 01-277274 | A | 11/1989 |
| JP | 02-129680 | A | 5/1990 |
| JP | 07-261589 | A | 10/1995 |
| JP | 07261589 | A * | 10/1995 |
| JP | 09-240877 | A | 9/1997 |

(Continued)

OTHER PUBLICATIONS

Extended European Search Report of related European Patent Application No. 12816629.5 dated Apr. 26, 2016.

*Primary Examiner* — David Gray
*Assistant Examiner* — Tyler Hardman
(74) *Attorney, Agent, or Firm* — Arent Fox LLP

(57) ABSTRACT

A fixing device 23 according to the present invention includes: a fixing roller 25 for fixing a toner image onto a sheet of paper; a plurality of separation claws 40 in contact with the fixing roller 25 to separate the sheet of paper, onto which the toner image is fixed, from the fixing roller 25; a holder 28 for supporting the plurality of separation claws 40; and a slide mechanism 30 for sliding the holder 28 along a longitudinal direction of the fixing roller 25.

7 Claims, 9 Drawing Sheets

(56) References Cited

FOREIGN PATENT DOCUMENTS

| | | | | |
|---|---|---|---|---|
| JP | 09240877 | A | * | 9/1997 |
| JP | 10-254284 | A | | 9/1998 |
| JP | 10254284 | A | * | 9/1998 |
| JP | 2006-189579 | A | | 7/2006 |
| JP | 2007-72259 | A | | 3/2007 |
| JP | 2007072259 | A | * | 3/2007 |
| JP | 2011-053414 | A | | 3/2011 |

* cited by examiner

FIXING DEVICE AND IMAGE FORMING APPARATUS

CROSS-REFERENCED TO RELATED APPLICATION

This application is a National Stage entry of International Application PCT/JP2012/072397, filed Sep. 4, 2012, which claims priority to Japanese Patent Application No. 2011-227888, filed Oct. 17, 2011, the disclosure of the prior application(s) are hereby incorporated in their entirety by reference.

TECHNICAL FIELD

The present invention relates to a fixing device for fixing a toner image onto a sheet of paper, and an image forming apparatus including the fixing device.

BACKGROUND ART

An electrophotographic image forming apparatus such as a copying machine and a printer has been conventionally provided with a fixing device by which a toner image is fixed onto a sheet of paper.

The fixing device includes, for example, a fixing roller and a pressurizing roller that is pressed against the fixing roller. The fixing device fixes the toner image onto the sheet of paper by heating and pressurizing the sheet of paper in a fixing nip formed between the fixing roller and the pressurizing roller. Moreover, the fixing device of such configuration includes a separation claw that is in contact with the fixing roller, the separation claw being used to separate the sheet of paper, onto which the toner image is fixed, from the fixing roller.

Normally, the aforementioned separation claw is in contact with the fixing roller at all times. Thus, a portion on the fixing roller in contact with the separation claw gets locally worn down, thereby causing a toner to get into the worn portion and generating a poor image. Now, there has been disclosed in Patent Document 1 a configuration which attempts to prevent the local wear on a fixing roller by alternating a separation claw to be brought into contact with the fixing roller in a fixing device including a plurality of separation claws.

[Patent Document 1] Japanese Unexamined Patent Application, Publication No. H07-261589

DISCLOSURE OF THE INVENTION

Problems to be Solved by the Invention

However, in the configuration described in Patent Document 1, the effect of preventing the local wear on the fixing roller has been realized to a limited extent, because each separation claw is brought into contact with the fixing roller always at the same position even when the separation claw to be abutted onto the fixing roller is alternated.

Moreover, in the configuration described in Patent Document 1, each separation claw is separately operated to be abutted onto/separated from the fixing roller. As a result, it has become difficult to improve the precision of a contact position between each separation claw and the fixing roller.

Therefore, an object of the present invention is to further improve durability of the fixing roller by suppressing the local wear thereon.

Means for Solving the Problems

A fixing device according to the present invention includes: a fixing roller, a plurality of separation claws, a holder, and a slide mechanism. The fixing roller fixes a toner image onto a sheet of paper. The plurality of separation claws contacts with the fixing roller to separate the sheet of paper, onto which the toner image is fixed, from the fixing roller. The holder supports the plurality of separation claws. The slide mechanism allows the holder to slide along a longitudinal direction of the fixing roller.

An image forming apparatus according to the present invention includes the aforementioned fixing device.

Effects of the Invention

The present invention allows for further improvement on the durability of the fixing roller by surely preventing the local wear on the fixing roller.

EXPLANATION OF REFERENCE NUMERALS

Figure 1:
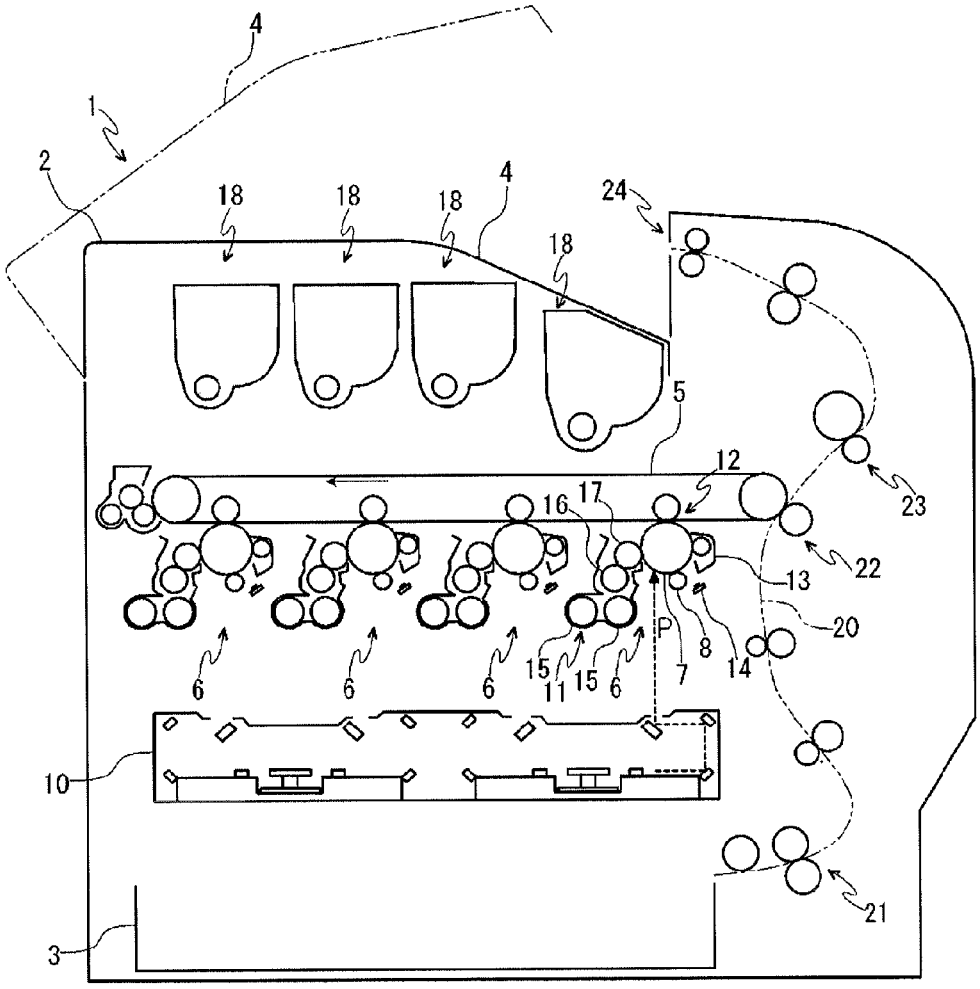
FIG. 1 is a schematic view illustrating an outline of a configuration of a color printer according to a first embodiment of the present invention.

1 color printer (image forming apparatus)
23 fixing device
25 fixing roller
27 peripheral surface
28 holder

30 slide mechanism
32 fixing roller rotating gear
40 separation claw
47 driving gear
48 cam
50 coil spring (energizing member)
51 decelerating gear
61 dial part (manual operation part)
62 cam
63 coil spring (energizing member)

PREFERRED MODE FOR CARRYING OUT THE INVENTION

First Embodiment

First, an overall configuration of a color printer 1 as an image forming apparatus will be described with reference to FIG. 1. FIG. 1 is a schematic view illustrating an outline of a configuration of a color printer according to a first embodiment of the present invention.

The color printer 1 includes a box-shaped printer body 2. A paper feeding cassette 3, in which a sheet of paper (not shown) is stored, is provided in a lower part of the printer body 2. An upper end of the printer body 2 is provided with an upper surface cover 4 that can be opened/closed and also serves as a paper eject tray.

An intermediate transfer belt 5 as an image carrier is installed across a plurality of rollers in an upper part of the printer body 2. An exposure unit 10 configured by a laser scanning unit (LSU) is disposed below the intermediate transfer belt 5. A plurality of image forming units 6 is provided along a lower part of the intermediate transfer belt 5. Each image forming unit 6 is provided corresponding to each color of yellow (Y), magenta (M), cyan (C), and black (K), for example. A photosensitive drum 7 is rotatably provided to each image forming unit 6. A charge unit 8, a developing unit 11, a primary transfer unit 12, a cleaning unit 13, and a static eliminator unit 14 are disposed around the photosensitive drum 7 in the order of a primary transfer process.

A pair of agitating rollers 15 is provided in a lower part of the developing unit 11. A magnetic roller 16 is provided obliquely above the agitating roller 15. A developing roller 17 is provided obliquely above the magnetic roller 16. A toner container 18 is provided above the developing unit 11. A toner is supplied from the toner container 18 to the developing unit 11.

A conveyance path 20 for conveying a sheet of paper is provided on one side (a right side in FIG. 1) of the printer body 2. A paper feeding unit 21 is provided at an upstream end of the conveyance path 20. A secondary transfer unit 22 is provided at an end (a right end in FIG. 1) of the intermediate transfer belt 5 in a midstream of the conveyance path 20. A fixing device 23 is provided in a downstream of the conveyance path 20. A paper ejection port 24 is provided at a downstream end of the conveyance path 20. Detail of the fixing device 23 will be described later.

Now, an image forming operation of the color printer 1 including such configuration will be described.

When the color printer 1 is turned on, various parameters are initialized so that a temperature setting or the like in the fixing device 23 is initialized. Then, image data is input from a computer or the like connected to the color printer 1, and the image forming operation will be executed as follows with an instruction to start printing.

The surface of the photosensitive drum 7 is first charged by the charge unit 8, and the photosensitive drum 7 is then exposed in accordance with the image data by a laser beam (refer to an arrow P) from the exposure unit 10 so that an electrostatic latent image is formed on the surface of the photosensitive drum 7. Next, the developing unit 11 develops the electrostatic latent image into a toner image of a corresponding color by a toner. The toner image is subjected to primary transfer onto the surface of the intermediate transfer belt 5 in the primary transfer unit 12. A full-color toner image will be formed on the intermediate transfer belt 5 by sequentially repeating the aforementioned operation by each image forming unit 6. Note that the toner and an electric charge remaining on the photosensitive drum 7 are removed by the cleaning unit 13 and the static eliminator unit 14.

On the other hand, a sheet of paper taken out from the paper feeding cassette 3 or a manual feed tray (not shown) by the paper feeding unit 21 is conveyed to the secondary transfer unit 22 in synchronized timing with the aforementioned image forming operation. In the secondary transfer unit 22, the full-color toner image on the intermediate transfer belt 5 is subjected to secondary transfer onto the sheet of paper. The sheet of paper processed with the secondary transfer of the toner image is conveyed in the conveyance path 20 to the downstream side and enters the fixing device 23. The toner image is fixed onto the sheet of paper in the fixing device 23. The sheet of paper onto which the toner image has been fixed is ejected from the paper ejection port 24 to the upper surface cover 4.

Figure 2:
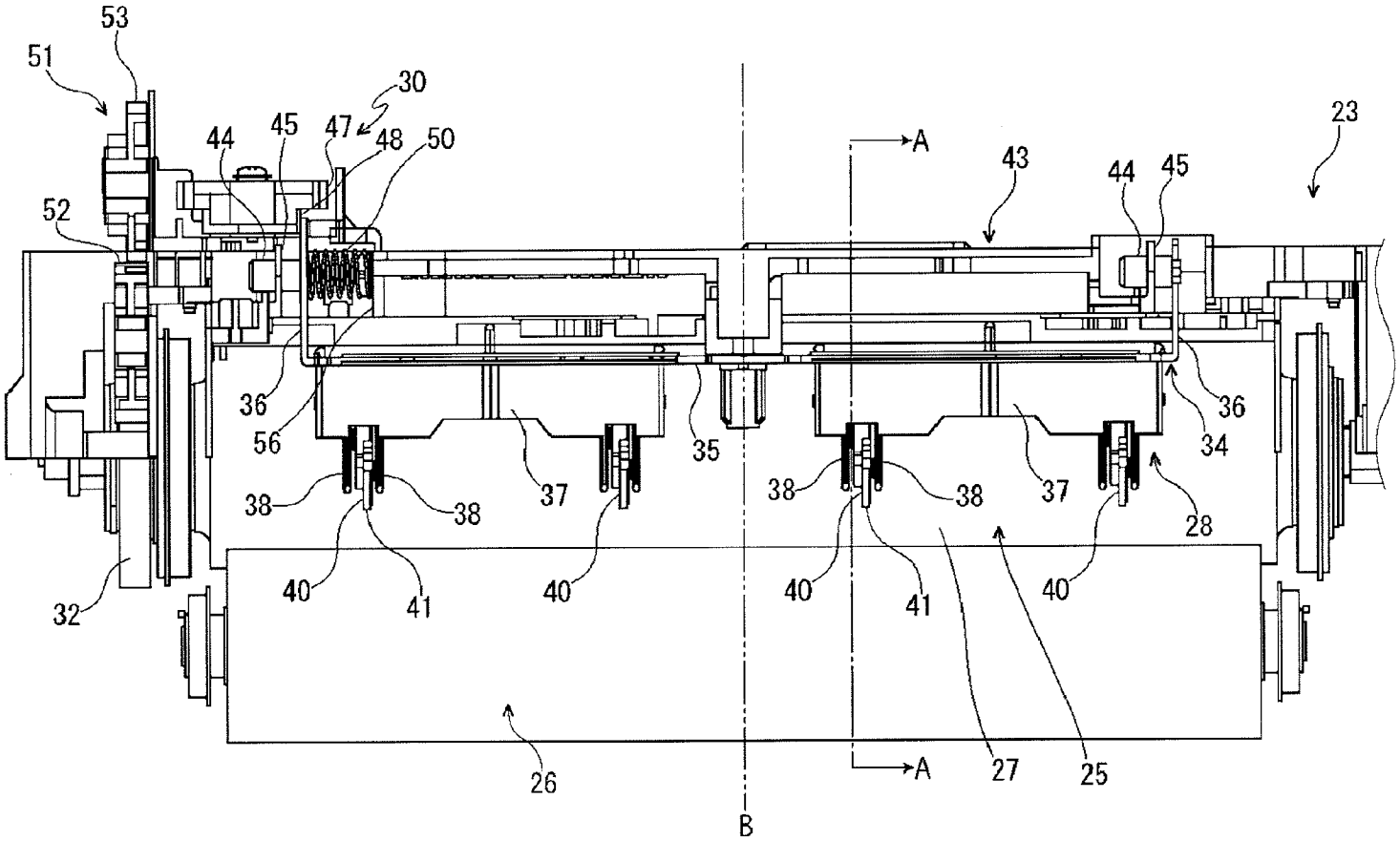
FIG. 2 is a side view of a fixing device in the color printer according to the first embodiment of the present invention.
Figure 3:
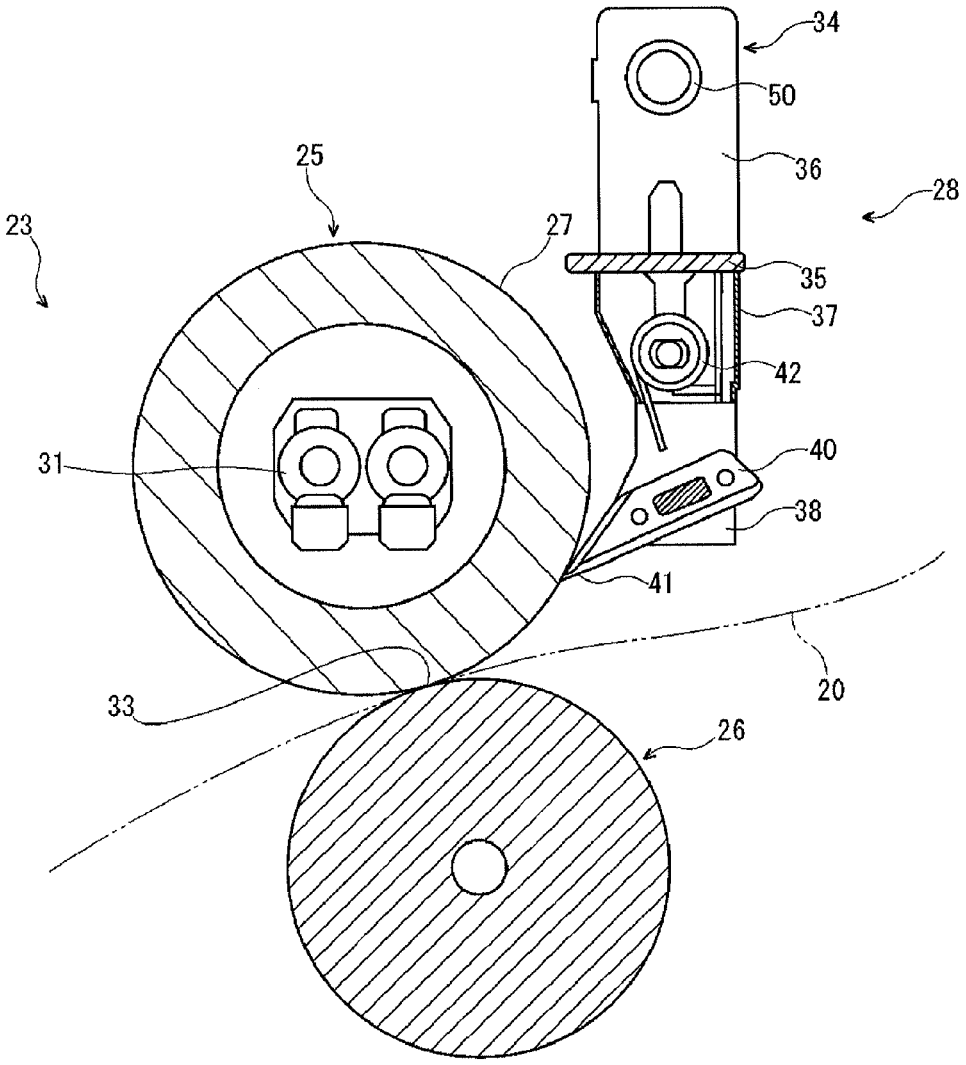
FIG. 3 is a cross-sectional view taken along line A-A in FIG. 2.
Figure 4:
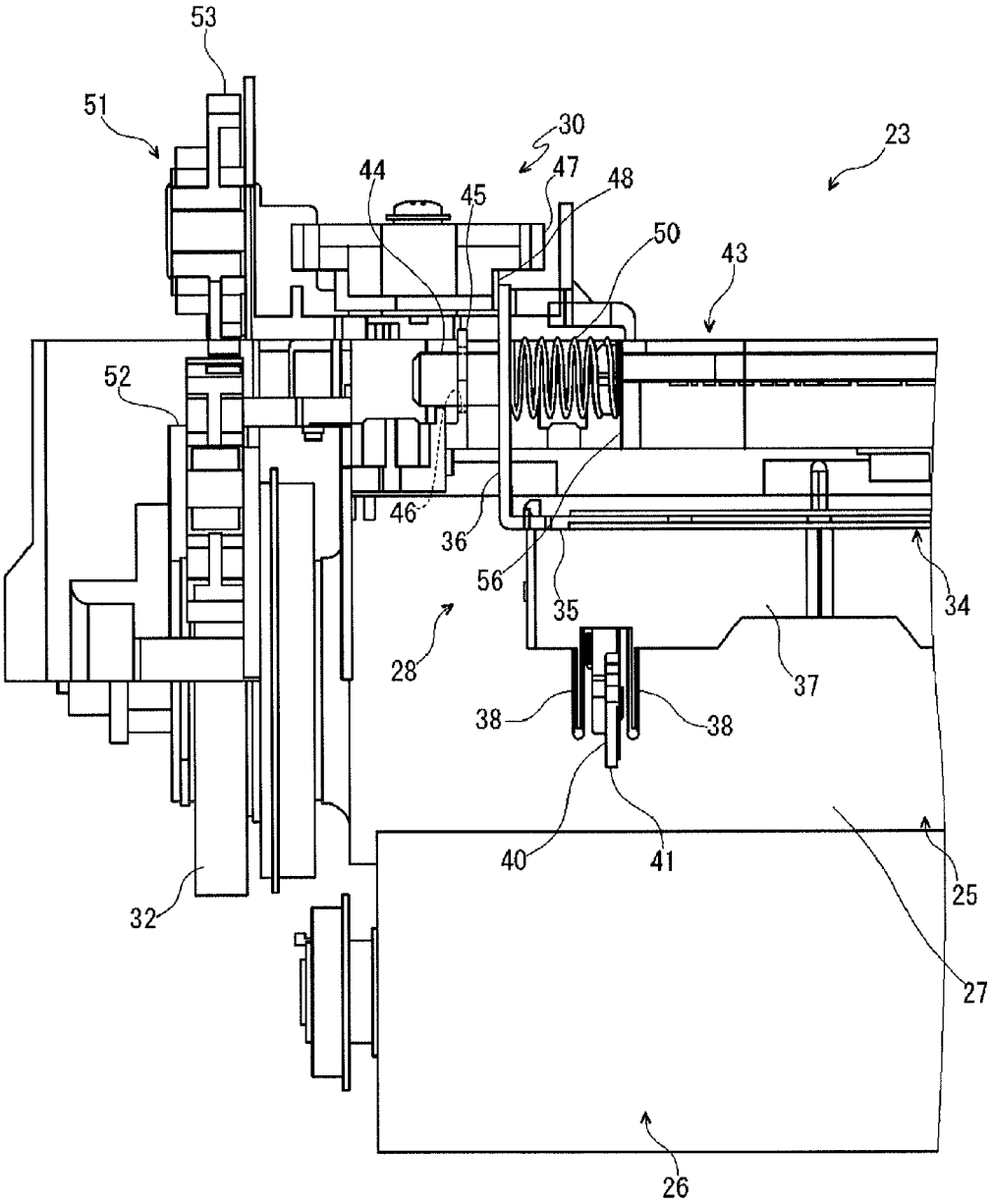
FIG. 4 is an enlarged view of an essential part in FIG. 2 in the color printer according to the first embodiment of the present invention.
Figure 5:
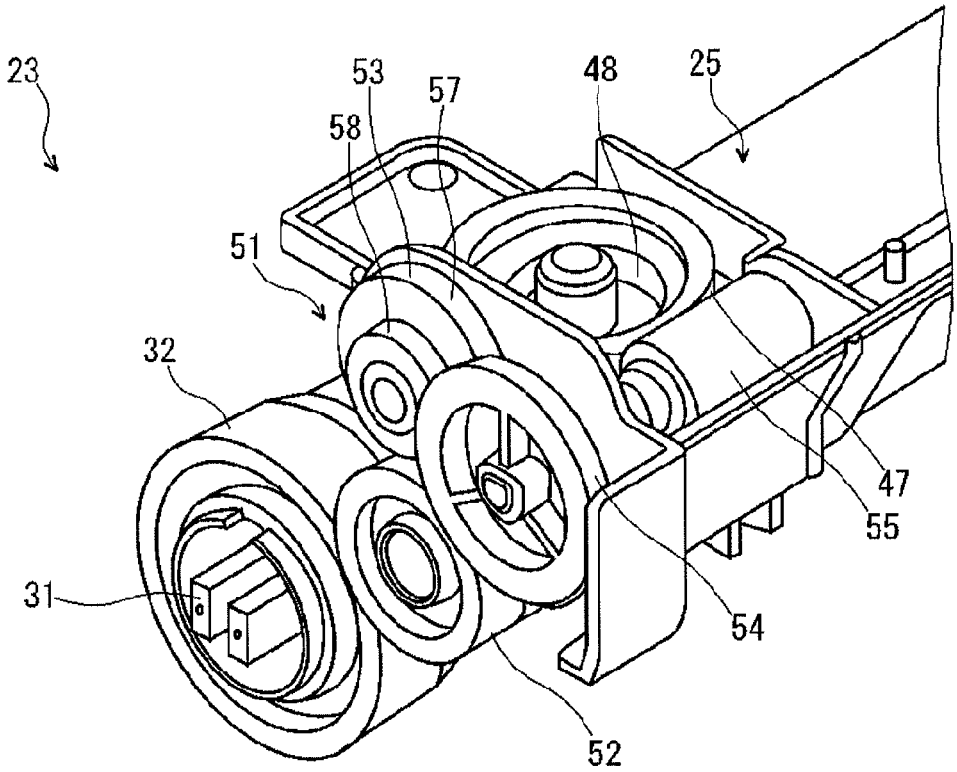
FIG. 5 is a perspective view illustrating a front part of the fixing device in the color printer according to the first embodiment of the present invention.
Figure 6:
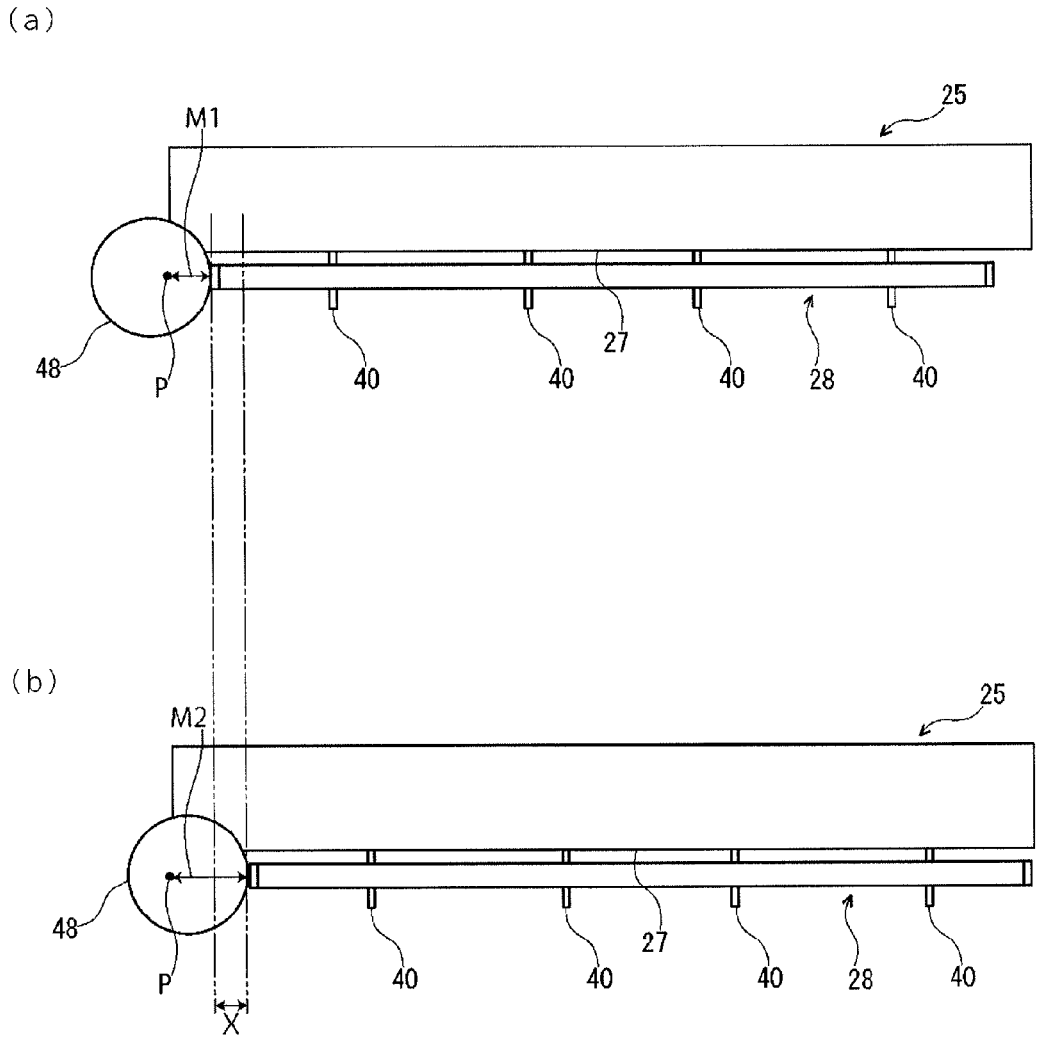
FIG. 6 is schematic views according to the color printer according to the first embodiment of the present invention. The (a) of FIG. 6 is a schematic view illustrating a state in which a portion on an outer peripheral surface of a cam closest to a center of rotation P thereof is in contact with a holder. The (b) of FIG. 6 is a schematic view illustrating a state in which a portion on the outer peripheral surface of the cam farthest from the center of rotation P thereof is in contact with the holder.

The detail of the fixing device 23 will now be described with reference to FIGS. 2 to 6. FIG. 2 is a side view of the fixing device in the color printer according to the first embodiment of the present invention. FIG. 3 is a cross-sectional view taken along line A-A in FIG. 2. FIG. 4 is an enlarged view of an essential part in FIG. 2 in the color printer according to the first embodiment of the present invention. FIG. 5 is a perspective view illustrating a front part of the fixing device in the color printer according to the first embodiment of the present invention. FIG. 6 is schematic views according to the color printer according to the first embodiment of the present invention. The (a) of FIG. 6 is a schematic view illustrating a state in which a portion on an outer peripheral surface of a cam closest to a center of rotation P thereof is in contact with a holder. The (b) of FIG. 6 is a schematic view illustrating a state in which a portion on the outer peripheral surface of the cam farthest from the center of rotation P thereof is in contact with the holder. For the convenience of explanation, a left side on the paper in FIG. 2 will hereinafter be an anterior side (a front side) of each member, and a right side on the paper in FIG. 2 will be a posterior side (a back side) of each member.

As illustrated in FIG. 2, the fixing device 23 includes a fixing roller 25, a pressurizing roller 26 disposed below the fixing roller 25, a holder 28 disposed in opposed relation to a peripheral surface 27 of the fixing roller 25, and a slide mechanism 30 provided at a front end side of the fixing roller 25.

The fixing roller 25 includes, for example, a cylindrical member formed of metal having superior thermal conductivity such as aluminum and iron, and a coating layer (such as a fluororesin layer) for coating the surface of the cylindrical member. A heater 31 (refer to FIG. 3 and the like) having a halogen heater, a ceramic heater, or the like is housed in the inner space of the fixing roller 25. The heater 31 generates heat when energized in order to heat the fixing roller 25.

A fixing roller rotating gear 32 is rotatably provided in integration with the fixing roller 25 at the front end thereof.

The fixing roller rotating gear 32 is connected to driving means (not shown) such as a motor. The driving force of the driving means is conveyed to the fixing roller rotating gear 32, thereby rotating the fixing roller 25.

The pressurizing roller 26 includes, for example: a cylindrical substrate layer formed of a synthetic resin, metal or the like; an elastic layer made of silicon rubber and formed on the surface of the substrate layer; and a coating layer made of fluororesin to coat the surface of the elastic layer. The pressurizing roller 26 is pressed against the fixing roller 25 by the energizing force of energizing means (not shown) and rotates following the rotation of the fixing roller 25. A fixing nip 33 (refer to FIG. 3) is formed between the fixing roller 25 and the pressurizing roller 26. The sheet of paper conveyed along the conveyance path 20 is heated and pressed in the fixing nip 33 to fix the toner image onto the sheet of paper. Note that the pressurizing roller 26 is omitted in FIGS. 4 and 6.

As illustrated in FIG. 2, the holder 28 includes an attachment plate 34 that is formed of a metal plate. The attachment plate 34 includes a fixing part 35 extending in a front-back direction and a bent part 36 being bent upward from the front and back ends of the fixing part 35, the attachment plate 34 being formed into a U shape in a side view.

A pair of front and back separation claw supporting plates 37 is fixed to the bottom surface of the fixing part 35 of the attachment plate 34 by fastening means (not shown) such as a screw. Each separation claw supporting plate 37 is made of resin and has a shape elongated in the front-back direction. A pair of front and back guide plates 38 juts out downward in the front and back parts of each separation claw supporting plate 37. Each separation claw supporting plate 37 is provided with two sets of the pair of front and back guide plates 38 with a total of four sets thereof provided overall.

A separation claw 40 is disposed between the pair of front and back guide plates 38. Four pieces of the separation claws 40 are disposed in accordance with the number of the pair of front and back guide plates 38. Each separation claw 40 is supported by each separation claw supporting plate 37 so that the separation claw 40 can swing about the upper end side thereof as a fulcrum. A contact portion 41 with a sharp shape is provided at the lower end of each separation claw 40. The contact portion 41 is energized toward the peripheral surface 27 of the fixing roller 25 by a twisted coil spring 42 (refer to FIG. 3) disposed in the vicinity of the swing fulcrum of the separation claw 40, and is pressed against the peripheral surface 27 of the fixing roller 25.

Among the four pieces of separation claws 40, the separation claw 40 supported in the back part of the front separation claw supporting plate 37 and the separation claw 40 supported in the front part of the back separation claw supporting plate 37 are disposed at an equal interval from the center part (refer to a two-dot chain line B in FIG. 2) of the fixing roller 25 in the longitudinal direction (the front-back direction in the present embodiment) thereof. The interval, at which the two pieces of separation claws 40 are disposed, is greater than a minimum possible paper feed width (an A6 size, for example). Among the four pieces of separation claws 40, the separation claw 40 supported in the front part of the front separation claw supporting plate 37 and the separation claw 40 supported in the back part of the back separation claw supporting plate 37 are disposed at an equal interval from the center part of the fixing roller 25 in the longitudinal direction thereof. The interval, at which the two pieces of separation claws 40 are disposed, is greater than a maximum possible paper feed width (a letter size, for example).

The holder 28 is supported by a cover member 43 of the fixing device 23 slidably in the front-back direction. In the support structure, a columnar projection 44 projected forward is fixed to each bent part 36 of the attachment plate 34 of the holder 28. On the other hand, a holder attachment plate 45 is provided to the cover member 43 in front of each bent part 36. A round hole 46 (refer to FIG. 4) is provided through each holder attachment plate 45 in the front-back direction. The projection 44 of each bent part 36 is slidably inserted into the round hole 46 in the front-back direction. By the aforementioned configuration, the holder 28 is slidably supported by the cover member 43 in the front-back direction.

As illustrated in FIG. 4, the slide mechanism 30 includes a driving gear 47 provided above the front end of the fixing roller 25, a cam 48 disposed below the driving gear 47 in a coaxial manner therewith, and a coil spring 50 disposed as an energizing member below and behind the driving gear 47 and the cam 48.

As illustrated in FIG. 5, the driving gear 47 is connected to the fixing roller rotating gear 32 through a decelerating gear 51. The decelerating gear 51 includes: a first connecting gear 52 engaged with the fixing roller rotating gear 32; a second connecting gear 53 for engaging the first connecting gear 52 with a major diameter part 57; a third connecting gear 54 engaged with a minor diameter part 58 of the second connecting gear 53; and a warm gear 55 rotatably provided in integration with the third connecting gear 54 and engaged with the driving gear 47. Once the fixing roller rotating gear 32 and the fixing roller 25 are rotated by the driving means (not shown) such as a motor, the rotation of the fixing roller rotating gear 32 is conveyed to the driving gear 47 via the decelerating gear 51, thereby causing the driving gear 47 to rotate. Note that the rotation of the fixing roller rotating gear 32 is decelerated by the decelerating gear 51 (particularly the warm gear 55) before being conveyed to the driving gear 47. As a result, the driving gear 47 rotates at a lower speed than the fixing roller rotating gear 32.

The cam 48 is integrally formed with the driving gear 47 and rotates in integration with the driving gear 47. The cam 48 has a cylindrical shape (a precise circle in a planar view). A center of rotation P of the cam 48 is decentered from the center of the precise circle of the cam 48 (refer to FIG. 6). As illustrated in FIG. 4, the back end of the cam 48 abuts on the upper end of the bent part 36 of the attachment plate 34 of the holder 28. Accordingly, the cam 48 can press the holder 28 along the longitudinal direction of the fixing roller 25.

The coil spring 50 is interposed between a spring supporting part 56 provided to the cover member 43 and the bent part 36 on the front side, behind the bent part 36 on the front side. The coil spring 50 energizes the holder 28 toward a side of the cam 48 (the front side in the present embodiment).

When the color printer 1 is on standby, the heater 31 does not heat the fixing roller 25. At the same time, the driving means (not shown) does not rotate the fixing roller rotating gear 32 so that the fixing roller 25 and the pressurizing roller 26 are not rotated.

On the other hand, when image data is input from an external computer or the like, the color printer 1 shifts from the standby state to an image forming state so that the heater 31 heats the fixing roller 25. At the same time, the driving means (not shown) rotates the fixing roller rotating gear 32 so that the fixing roller 25 and the pressurizing roller 26 are rotated. Such rotation of the fixing roller rotating gear 32 is conveyed to the driving gear 47 via the decelerating gear 51, thereby causing the driving gear 47 and the cam 48 to rotate.

An effect accompanying the rotation of the cam 48 will now be described. The cam 48 is rotated from a state in which a portion on the peripheral surface of the cam 48 closest to the center of rotation P thereof (a distance M1 from the center of rotation P) is in contact with the holder 28 (refer to (a) of FIG. 6). Then, the holder 28 is pressed by the cam 48 and slides backward against the energizing force of the coil spring 50. Accompanying the sliding of the holder 28, the four pieces of separation claws 40 supported by the holder 28 slide backward while maintaining contact with the fixing roller 25.

On the other hand, the cam 48 is rotated from a state in which a portion on the peripheral surface of the cam 48 farthest from the center of rotation P thereof (a distance M2 from the center of rotation P) is in contact with the holder 28 (refer to (b) of FIG. 6). Then, the holder 28 slides forward by the energizing force of the coil spring 50. Accompanying the sliding of the holder 28, the four pieces of separation claws 40 supported by the holder 28 slide forward while maintaining contact with the fixing roller 25.

A position, to which the cam 48 presses the holder 28 would continuously change as long as the cam 48, is being rotated. The backward and the forward sliding of the separation claws 40 (sliding along the longitudinal direction of the fixing roller 25) will be repeated continuously. Note that an arrow X in FIG. 6 indicates a slide width of the holder 28 and the separation claws 40.

On the other hand, when the color printer 1 returns to the standby state from the image forming state, the fixing roller 25, the pressurizing roller 26, the fixing roller rotating gear 32, the decelerating gear 51, the driving gear 47, and the cam 48 would stop rotating as well as the separation claws 40 would stop sliding.

In the present embodiment, as described above, the contact position between the fixing roller 25 and the plurality of separation claws 40 is varied along the longitudinal direction of the fixing roller 25 by sliding the holder 28, that supports the plurality of separation claws 40, along the longitudinal direction of the fixing roller 25. As a result, the local wear on the fixing roller 25 can be suppressed to improve the durability of the fixing roller 25 as compared to the case where each separation claw 40 is in contact with the fixing roller 25 always at the same position. Moreover, each separation claw 40 can have the same slide width by sliding the plurality of separation claws 40 integrally with the holder 28. As a result, the precision of the contact position between each separation claw 40 and the fixing roller 25 can be improved as compared to the case where each separation claw 40 is moved separately.

In the present embodiment, moreover, the separation claw 40 slides automatically accompanying the driving of the fixing roller 25 by connecting the driving gear 47 to the fixing roller rotating gear 32. As a result, a workload on a user or a serviceman can be reduced as compared to the case where the separation claw 40 is slid manually.

Moreover, in the present embodiment, the driving gear 47 and the cam 48 can be rotated at a lower speed than the fixing roller 25 by decelerating rotation of the fixing roller rotating gear 32 by the decelerating gear 51, thereby allowing the separation claw 40 to slide at a low speed. As a result, a malfunction such as a paper jam (JAM) caused by sliding the separation claw 40 too fast can be suppressed.

Moreover, in the present embodiment, the facts, that the separation claw 40 slides automatically and that the cam 48 has a cylindrical shape, have allowed the position to which the cam 48 presses the holder 28 to be changed continuously and, at the same time, allowed the separation claw 40 to slide smoothly. In short, the cylindrical configuration of the cam 48 is suitable for sliding the separation claw 40 automatically.

Figure 7A:
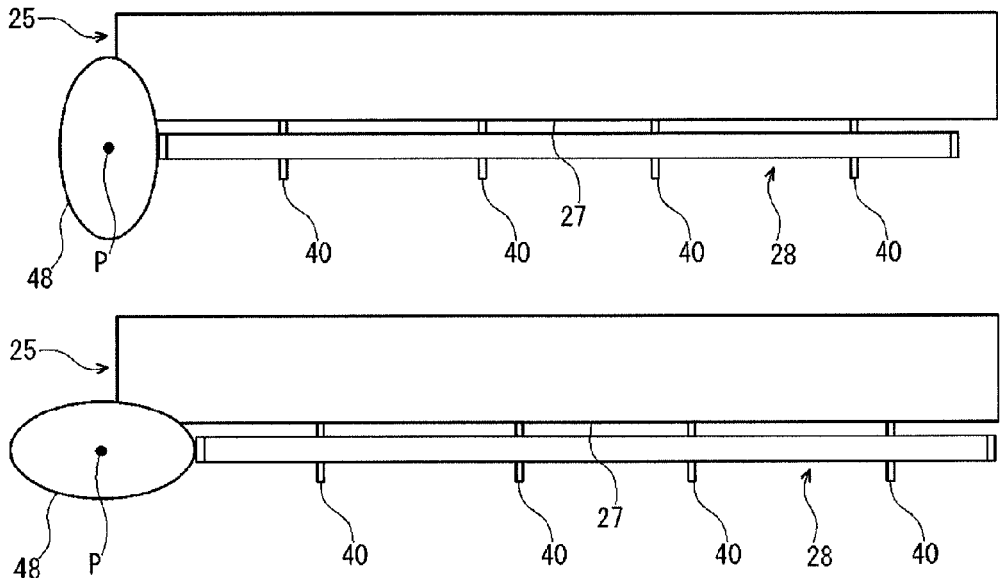
FIG. 7A is a set of schematic views in which a cam has an elliptical shape in a planar view in a color printer according to Modified Example 1.
Figure 7B:
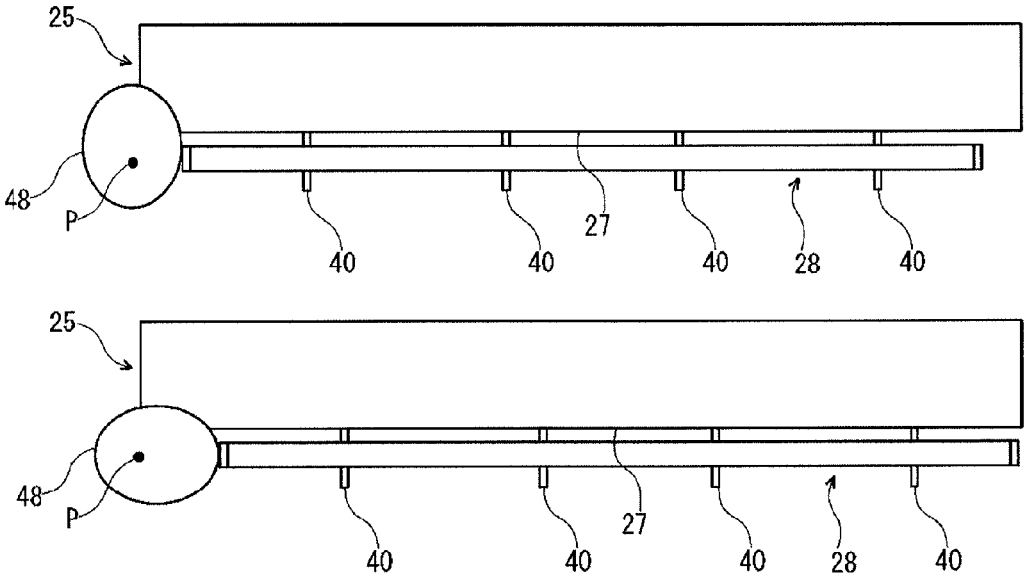
FIG. 7B is a set of schematic views in which a cam has an elliptical shape in a planar view in a color printer according to Modified Example 2.

Described in the present embodiment is the case where the cam 48 is a precise circle in a planar view. In Modified Example, however, a cam 48 that has an elliptical shape in a planar view may also be employed as illustrated in FIGS. 7A and 7B. When using the cam 48 having the elliptical shape in the planar view, a center of rotation P of the cam 48 may be provided in the center of the ellipse as illustrated in FIG. 7A, or may be decentered from the center of the ellipse as illustrated in FIG. 7B. Moreover, the cylindrical cam 48 used in the present embodiment may also be a columnar cam. Moreover, a cam having a polygonal cylindrical shape or a polygonal columnar shape (refer to a second embodiment) may be used.

Second Embodiment

Figure 8:
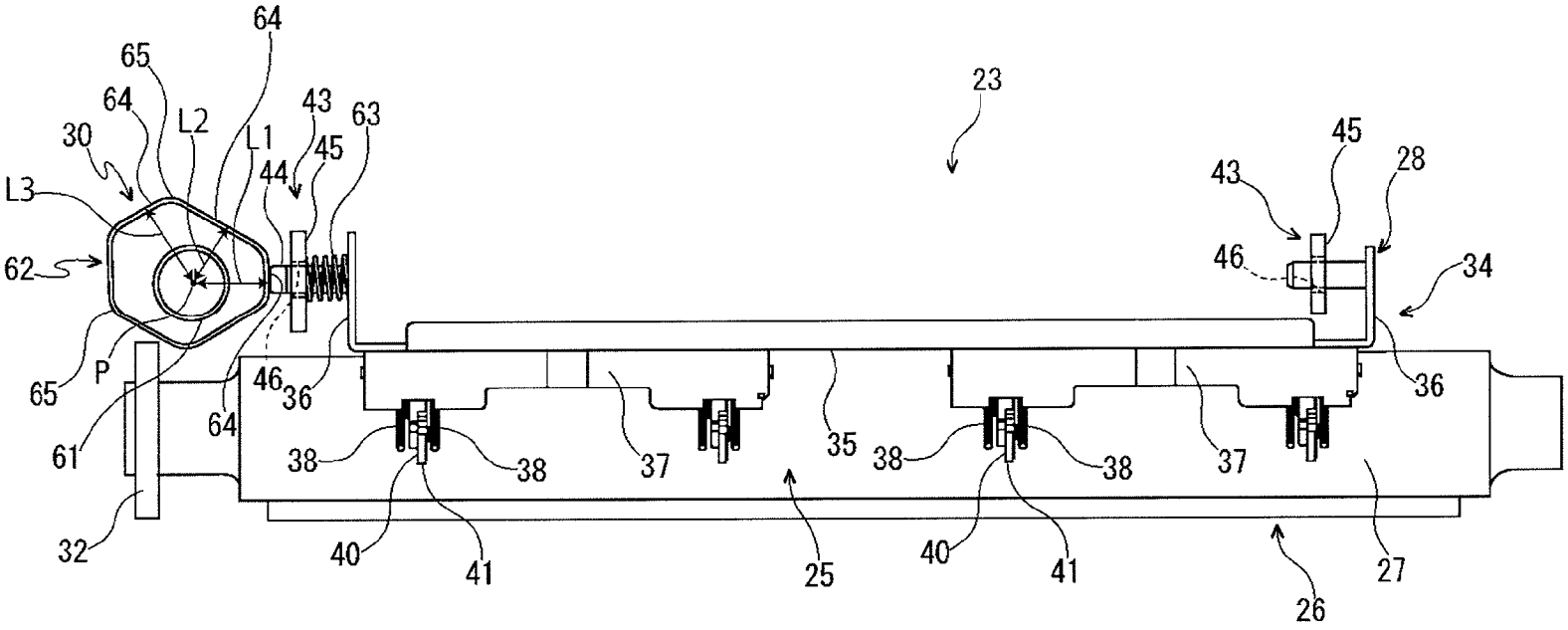
FIG. 8 is a plan view in which a cam surface, that is away from a center of rotation P of a cam by a distance L1, is in contact with a holder in a fixing device of a color printer according to a second embodiment of the present invention.
Figure 9:
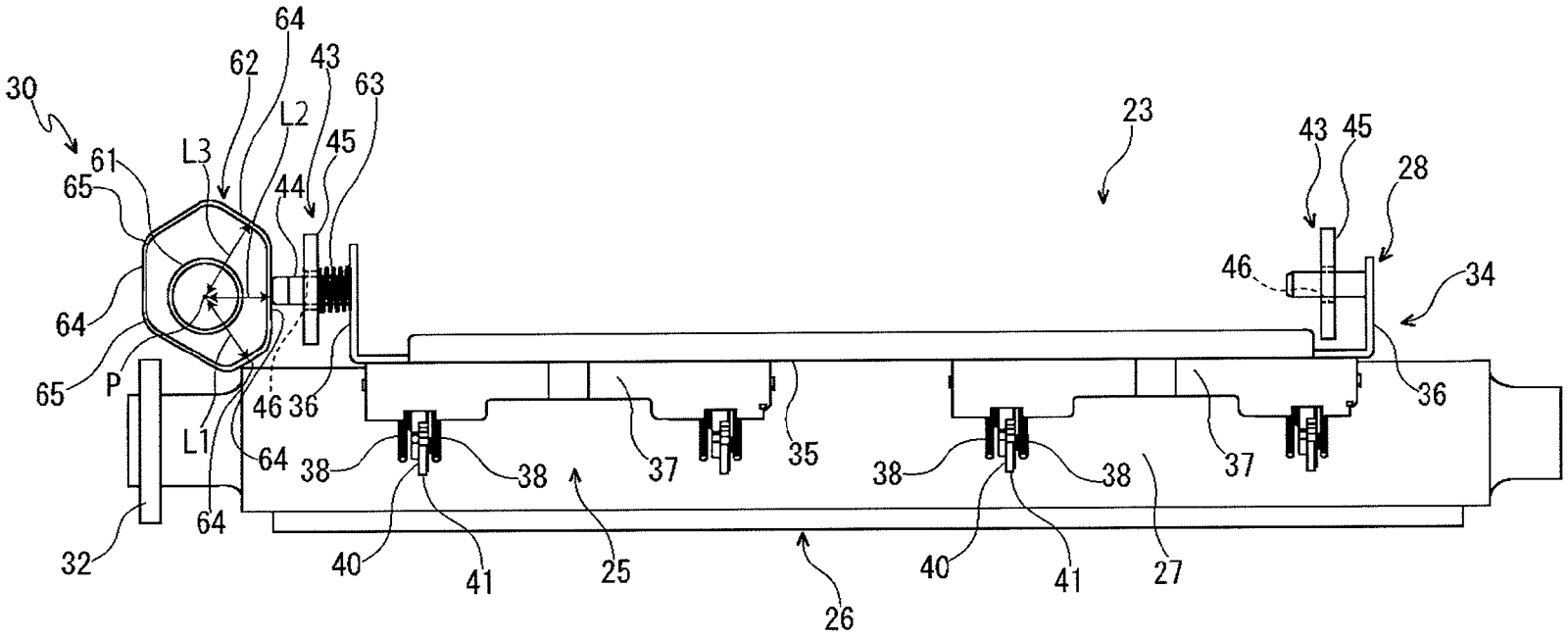
FIG. 9 is a plan view in which a cam surface, that is away from the center of rotation P of the cam by a distance L2, is in contact with the holder in the fixing device of the color printer according to the second embodiment of the present invention.

The detail of a color printer according to a second embodiment will now be described with reference to FIGS. 8 and 9. FIG. 8 is a plan view in which a cam surface, that is away from a center of rotation P of a cam by a distance L1, is in contact with a holder in a fixing device of the color printer according to the second embodiment of the present invention. FIG. 9 is a plan view in which a cam surface, that is away from the center of rotation P of the cam by a distance L2, is in contact with the holder in the fixing device of the color printer according to the second embodiment of the present invention. Note that the description of the configuration of parts identical to that of the first embodiment, other than a slide mechanism 30 in a fixing device 23, will be omitted.

The slide mechanism 30 includes: a dial part 61 as a manual operation part provided at an upper left of the front end of a fixing roller 25; a cam 62 disposed coaxially with the dial part 61; and a coil spring 63 as an energizing member disposed at the back of the dial part 61 and the cam 62.

The dial part 61 is rotatably supported by a cover member 43 (parts of which except for a holder attachment plate 45 are not shown in FIGS. 8 and 9). The dial part 61 is configured to turn stepwise by 60 degrees, for example.

The cam 62 is configured to be rotated manually accompanying the turning of the dial part 61. The cam 62 has a hexagonal columnar shape (a hexagonal shape in a planar view). A curvature 65 is formed between each cam surface 64 of the cam 62. A distance from a center of rotation P of the cam 62 to each cam surface 64 of the cam 62 is configured to be different (refer to L1 to L3 in FIGS. 8 and 9). The back end of the cam 62 abuts on a projection 44 of a holder 28. As a result, the cam 62 can press the holder 28 along the longitudinal direction of the fixing roller 25.

The coil spring 63 is interposed between the holder attachment plate 45 of the cover member 43 and a bent part 36 on the front side. The coil spring 63 energizes the holder 28 toward a side of the cam 62 (the front side in the present embodiment).

While the cam surface 64, that is away from the center of rotation P of the cam 62 by a distance L1, is in contact with the projection 44 of the holder 28 (refer to FIG. 8), the printer configured in the aforementioned manner performs printing until, for example, a predetermined number of sheets has been printed or a predetermined time has elapsed.

A serviceman or a user thereafter turns the dial part 61 by 60 degrees in one direction (clockwise in the figure). As a result, the cam surface 64, that is away from the center of rotation P of the cam 62 by a distance L2 (L2<L1), is brought into contact with the projection 44 of the holder 28, as illustrated in FIG. 9. At the same time, the holder 28 slides forward by the energizing force of the coil spring 63. Accompanying the sliding of the holder 28, the four pieces of separation claws 40 supported by the holder 28 slide forward while maintaining contact with the fixing roller 25.

Printing is performed in this state until a predetermined number of sheets has been printed or a predetermined time has elapsed and, thereafter, the serviceman or the user turns the dial part 61 again by 60 degrees in one direction. Although not shown, the cam surface 64, that is away from the center of rotation P of the cam 62 by a distance L3 (L3>L2), is brought into contact with the projection 44 of the holder 28. As a result, the holder 28 is pressed by the cam 62 and slides backward against the energizing force of the coil spring 63. Accompanying the sliding of the holder 28, the four pieces of separation claws 40 supported by the holder 28 slide backward while maintaining contact with the fixing roller 25.

Accordingly, the position to which the cam 62 presses the holder 28 changes stepwise every time the serviceman or the user turns the dial part 61 by 60 degrees in one direction, thereby causing the holder 28 and the separation claw 40 to slide forward or backward.

In the present embodiment, the dial part 61, the cam 62, and the coil spring 63 constitute the slide mechanism 30. By adopting such configuration, the separation claw 40 can be slid manually by a simple configuration so that a manufacturing cost can be reduced as compared to the case where the separation claw 40 slides automatically.

Moreover, in the present embodiment, the cam 62 has the hexagonal columnar shape (the hexagonal shape in the planar view), and each cam surface 64 is formed to have a different distance from the center of rotation P of the cam 62. As a result, the position to which the cam 62 presses the holder 28 can be changed stepwise and, at the same time, the contact position between the separation claw 40 and the fixing roller 25 can be switched stepwise. In short, the polygonal columnar cam 62 is suitable for sliding the separation claw 40 manually.

Described in the present embodiment is the case where the hexagonal columnar cam 62 is used. However, the cam 62 may also have another polygonal columnar shape having the different number of edges such as a square column and an octagonal column. Moreover, the polygonal columnar cam 62 used in the present embodiment may also be a polygonal cylindrical cam. Moreover, a cylindrical or a columnar cam (refer to the first embodiment) may be used.

The number of separation claws is not limited to the case in the first and the second embodiments where the four pieces of separation claws 40 are brought into contact with the peripheral surface 27 of the fixing roller 25. That is, for example, two or six pieces of the separation claws 40 other than four pieces thereof may be brought into contact with the peripheral surface 27 of the fixing roller 25.

The means for heating the fixing roller 25 is not limited to the heater 31 as in the first and the second embodiments. The fixing roller 25 may also be heated by another heating means such as an IH fixing unit.

The present invention can be applied not only to the color printer 1 of a tandem type as described in the first and the second embodiments, but also to another image forming apparatus. That is, the present invention can also be applied to another image forming apparatus such as a color printer of a rotary type, a black and white printer, a copying machine, a digital multifunction machine, and a facsimile.

The invention claimed is:

1. A fixing device comprising:

a fixing roller for fixing a toner image onto a sheet of paper;

a plurality of separation claws that are in contact with the fixing roller to separate a sheet of paper, onto which a toner image is fixed, from the fixing roller;

a holder for supporting the plurality of separation claws;

a slide mechanism for sliding the holder along an axial direction of the fixing roller; and a fixing roller rotating gear configured to be rotatable integrally with the fixing roller, wherein the slide mechanism comprises:

a driving gear configured to be rotatable to mesh with the fixing roller rotating gear; and a cam configured to be formed integrally with the driving gear and rotatable integrally therewith, such that the cam presses the holder along the axial direction of the fixing roller, wherein the drive gear and the cam compose a cylinder of one piece in which the drive gear and the cam are adjacent to each other in an axial direction of the cylinder without interposing an intermediate element therebetween, wherein the holder, when viewed in a side view, comprises a U-shaped attachment plate, and the cam is configured to abut on an upper end of one of a pair of bent parts projecting at ends of the attachment plate, said ends being defined with respect to the axial direction of the fixing roller, and wherein a pair of separation claw supporting plates, to which the plurality of separation claws are fixed, is fixed to a bottom of the U-shaped attachment plate in an opposite direction with respect to the pair of bent parts and at an equal interval from a center part of the fixing roller in the axial direction of the fixing roller.

2. The fixing device according to claim 1, wherein the slide mechanism further comprises:

a biasing member configured to bias the holder toward the cam, wherein a position to which the holder is pressed by the cam changes with rotation of the cam.

3. The fixing device according to claim 2, further comprising:

a decelerating gear that decelerates rotation of the fixing roller rotating gear to convey the rotation to the driving gear.

4. The fixing device according to claim 2, wherein the cylinder is solid or hollow and the cam is configured to press the holder such that the position of the holder changes continuously.

5. The fixing device according to claim 3, wherein the cylinder is solid or hollow and the cam is configured to press the holder such that the position of the holder changes continuously.

6. The fixing device according to claim 1, wherein a columnar projection is fixed to each of the pair of bent parts of the U-shaped attachment plate, a pair of holder attachment plates is provided at a cover configured to cover the fixing device, the columnar projection is inserted in a round hole provided at each of the pair of holder attachment plates, and the holder is configured to be supported by the cover slidably in the axial direction of the fixing roller.

7. An image forming apparatus comprising the fixing device according to claim 1.

* * * * *